US010895827B2

(12) United States Patent
Ohhira et al.

(10) Patent No.: US 10,895,827 B2
(45) Date of Patent: Jan. 19, 2021

(54) DEVELOPER CONVEYOR HAVING THREE BLADES

(71) Applicants: Tatsuya Ohhira, Kanagawa (JP); Koichi Yamazaki, Kanagawa (JP); Hideo Yoshizawa, Kanagawa (JP); Takahiro Adachi, Kanagawa (JP)

(72) Inventors: Tatsuya Ohhira, Kanagawa (JP); Koichi Yamazaki, Kanagawa (JP); Hideo Yoshizawa, Kanagawa (JP); Takahiro Adachi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/775,727

(22) Filed: Jan. 29, 2020

(65) Prior Publication Data

US 2020/0264538 A1 Aug. 20, 2020

(30) Foreign Application Priority Data

Feb. 18, 2019 (JP) ..... 2019-026265

(51) Int. Cl.

| | |
|---|---|
| ***G03G 15/08*** | (2006.01) |
| ***B01F 7/00*** | (2006.01) |
| ***B01F 7/08*** | (2006.01) |

(52) U.S. Cl.

CPC ..... *G03G 15/0891* (2013.01); *B01F 7/088* (2013.01); *G03G 15/0893* (2013.01); *G03G 2215/083* (2013.01); *G03G 2215/0838* (2013.01)

(58) Field of Classification Search

CPC ..... G03G 15/0891; G03G 15/0893; G03G 2215/0822; G03G 2215/0819; G03G 2215/083; G03G 2215/0838; B01F 7/088; B01F 7/00633

USPC ..... 399/256; 366/296, 321, 322

See application file for complete search history.

(56) References Cited

U.S. PATENT DOCUMENTS

| | | | | |
|---|---|---|---|---|
| 3,421,740 | A * | 1/1969 | Behrens | B01F 13/0035 366/186 |
| 4,193,696 | A * | 3/1980 | Van Heel | B01F 7/00416 366/66 |
| 8,837,991 | B2 * | 9/2014 | Iwata | G03G 15/0893 399/254 |
| 2008/0260430 | A1 * | 10/2008 | Sakamoto | G03G 15/0822 399/254 |
| 2011/0069993 | A1 * | 3/2011 | Yamamuro | G03G 15/0893 399/254 |
| 2012/0189350 | A1 | 7/2012 | Kubota et al. | |

(Continued)

FOREIGN PATENT DOCUMENTS

| | | |
|---|---|---|
| JP | 2005-173543 | 6/2005 |
| JP | 2012-155142 | 8/2012 |

(Continued)

*Primary Examiner* — Robert B Beatty

(74) *Attorney, Agent, or Firm* — Oblon, McClelland, Maier & Neustadt, L.L.P.

(57) ABSTRACT

A developer conveyor includes a shaft; a first blade helically wound around the shaft in a first direction, a second blade disposed away from an end of the first blade with a gap in a longitudinal axial direction of the developer conveyor and helically wound around the shaft in a second direction opposite the first direction, and a third blade helically wound around the shaft in the first direction at least at a position where the gap is formed.

11 Claims, 3 Drawing Sheets

(56) References Cited

U.S. PATENT DOCUMENTS

| | | | | |
|---|---|---|---|---|
| 2012/0201573 | A1* | 8/2012 | Watanabe | G03G 15/0853 399/256 |
| 2014/0212180 | A1 | 7/2014 | Kadota et al. | |
| 2015/0139697 | A1* | 5/2015 | Tsukijima | G03G 15/0893 399/254 |
| 2016/0062274 | A1* | 3/2016 | Kadota | G03G 21/12 399/254 |
| 2017/0293257 | A1 | 10/2017 | Ohhira et al. | |
| 2017/0336733 | A1 | 11/2017 | Adachi et al. | |
| 2018/0136586 | A1 | 5/2018 | Tsuchiya et al. | |
| 2018/0143568 | A1 | 5/2018 | Ohhira et al. | |
| 2018/0164718 | A1* | 6/2018 | Suenami | G03G 15/0893 |
| 2018/0253033 | A1* | 9/2018 | Fujishima | G03G 15/0891 |

FOREIGN PATENT DOCUMENTS

| | | |
|---|---|---|
| JP | 2012-208422 | 10/2012 |
| JP | 2016-166991 | 9/2016 |

* cited by examiner

DEVELOPER CONVEYOR HAVING THREE BLADES

CROSS-REFERENCE TO RELATED APPLICATION

This patent application is based on and claims priority pursuant to 35 U.S.C. § 119(a) to Japanese Patent Application No. 2019-026265, filed on Feb. 18, 2019, in the Japan Patent Office, the entire disclosure of which is hereby incorporated by reference herein.

BACKGROUND

Technical Field

Embodiments of the present disclosure generally relate to a developer conveyor to transport a developer in a longitudinal axial direction of the developer conveyor, a developing device incorporating the developer conveyor, a process cartridge incorporating the developing device, and an image forming apparatus, such as a copier, a printer, a facsimile machine, or a multifunction peripheral (MFP) having at least two of such capabilities.

Description of the Related Art

Developing devices employing a developer conveyor (conveying screw) are widely used in image forming apparatuses such as copiers, printers, facsimile machines, and MFPs. The developer conveyor (conveying screw) transports a developer, such as a two-component developer including toner and carrier, in a longitudinal axial direction of the developer conveyor.

In the developing device using the two-component developer, toner is supplied to the developing device through a toner supply inlet disposed in the developing device in response to the amount of toner consumed in the developing device. The supplied toner is stirred and mixed with the developer in the developing device by the developer conveyor (conveying screw), while being transported in the longitudinal axial direction. A portion of the stirred developer contained in the developing device is supplied to a developing roller (developer bearer). When the developer carried on the developing roller reaches a position opposite a doctor blade, which is opposed to the developing roller, an amount of the developer on the developing roller is adjusted to a suitable amount by the doctor blade (developer regulator). Then, the developer is transported to a position opposite the photoconductor drum (image bearer) and toner in the two-component developer adheres to latent images on the photoconductor drum.

SUMMARY

Embodiments of the present disclosure describe an improved developer conveyor that includes a shaft, a first blade helically wound around the shaft in a first direction, a second blade disposed away from an end of the first blade with a gap in a longitudinal axial direction of the developer conveyor and helically wound around the shaft in a second direction opposite the first direction, and a third blade helically wound around the shaft in the first direction at least at a position where the gap is formed.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
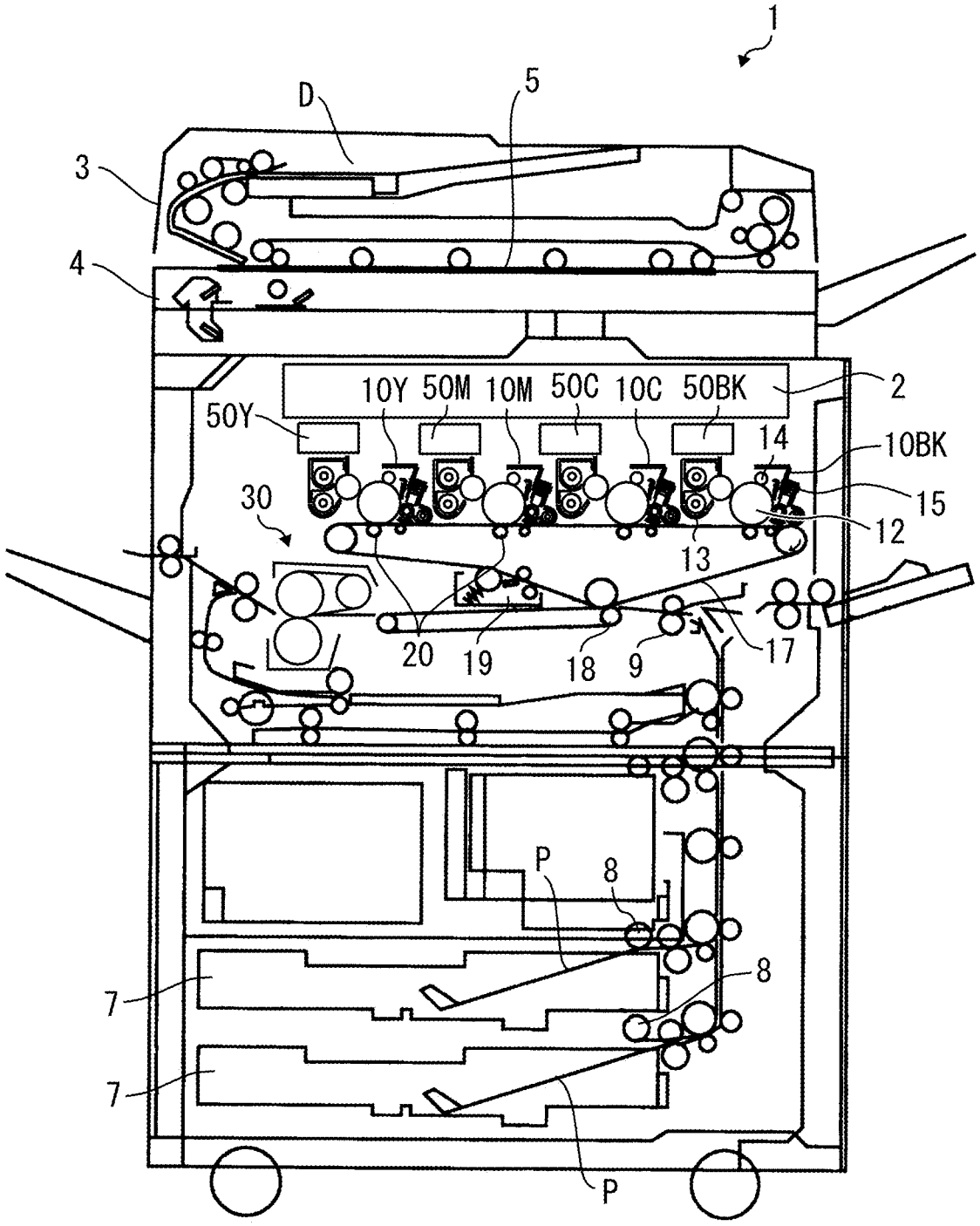
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

Embodiments of the present disclosure are described in detail with reference to drawings. Identical reference numerals are assigned to identical components or equivalents and a description of those components is simplified or omitted.

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and BK attached to each reference numeral indicate only that components indicated thereby are used for forming yellow, magenta, cyan, and black images, respectively, and hereinafter may be omitted when color discrimination is not necessary.

With reference to FIG. 1, the configuration and operation of an image forming apparatus 1 are described below.

In FIG. 1, the image forming apparatus 1, which is a tandem color copier in the present embodiment, includes a writing device 2, a document conveyance device 3, a scanner (document reading device) 4, a sheet feeding device 7, and a registration roller pair 9. The document conveyance device 3 feeds a document D to the scanner 4. The scanner 4 scans image data for the document D. The writing device 2 emits a laser beam based on input image data. The sheet feeding device 7 contains sheets P such as paper sheets. The registration roller pair (timing roller pair) 9 adjusts the timing of conveyance of the sheet P.

The image forming apparatus 1 further includes four process cartridges (image forming units) 10Y, 10M, 10C, and 10BK that form toner images of yellow, magenta, cyan, and black, respectively.

The image forming apparatus 1 further includes an intermediate transfer belt 17, a secondary transfer roller 18, a belt cleaning device 19. The toner images of yellow, magenta, cyan, and black are transferred to and superimposed on the intermediate transfer belt 17, thereby forming a multicolor toner image. The secondary transfer roller 18 transfers the multicolor toner image from the intermediate transfer belt 17 onto the sheet P. The belt cleaning device 19 cleans the intermediate transfer belt 17.

The image forming apparatus 1 also includes primary transfer rollers 20, a fixing device 30, and toner cartridges (toner containers) 50Y, 50M, 50C, and 50BK. The primary transfer rollers 20 transfer and superimpose the toner images formed on photoconductor drums 12 of the process cartridges 10Y, 10M, 10C, and 10BK onto the intermediate transfer belt 17. The fixing device 30 fixes the unfixed multicolor toner image on the sheet P. The toner cartridges 50Y, 50M, 50C, and 50BK contain respective color toners (yellow, magenta, cyan, and black toners).

A description is provided of image forming processes of the image forming apparatus 1 to form the multicolor toner image.

Figure 2:
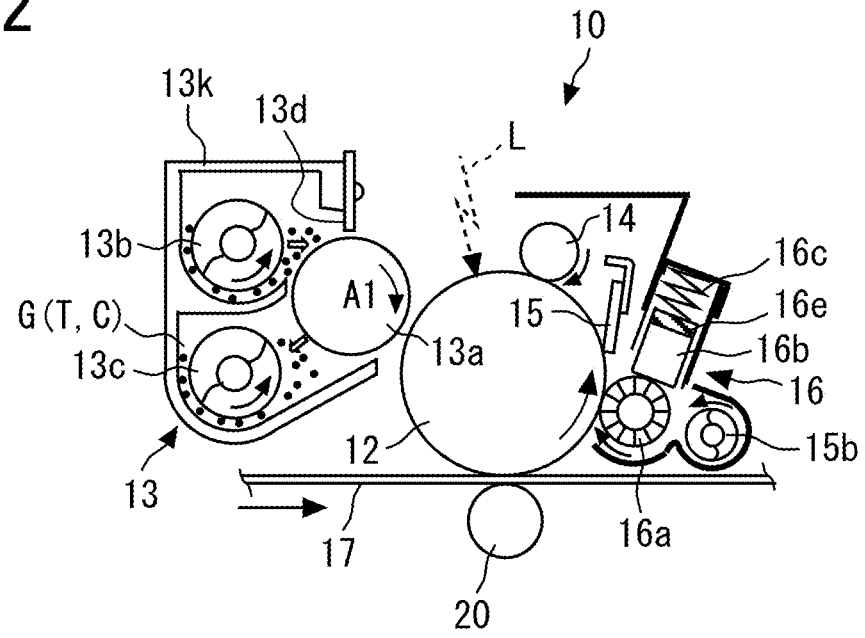
FIG. 2 is a schematic view illustrating a configuration of an image forming unit of the image forming apparatus in FIG. 1.

It is to be noted that FIG. 2 is also referred to when the image forming processes performed on the photoconductor drums 12 of the process cartridges 10Y, 10M, 10C, and 10BK are described.

The document conveyance device 3 transports, with conveyance rollers, the document D from a document table onto a platen (exposure glass) 5 of the scanner 4. Then, the scanner 4 optically scans image data for the document D set on the platen 5.

The yellow, magenta, cyan, and black image data are transmitted to the writing device 2. The writing device 2 directs a laser beam L (see FIG. 2) onto a surface of the corresponding photoconductor drum 12 according to the image data for each color.

Meanwhile, the photoconductor drums 12 of the four process cartridges 10Y, 10M, 10C, and 10BK rotate counterclockwise in FIG. 1. A charging device 14 uniformly charges the surface of the photoconductor drum 12 at a position facing each other (charging process). Thus, the surface of the photoconductor drum 12 is charged to a certain potential. Subsequently, the surface of the photoconductor drum 12 thus charged reaches a position where the surface of the photoconductor drum 12 is irradiated with the laser beam L.

The writing device 2 emits the laser beam L for each color from each of four light sources according to the image data. The respective laser beams L pass through different optical paths for the different components of yellow, magenta, cyan, and black (exposure process).

The laser beam L for the yellow component is directed to the surface of the photoconductor drum 12 in the process cartridge 10Y, which is the first from the left in FIG. 1 among the four process cartridges 10Y, 10M, 10C, and 10BK. At that time, a polygon mirror rotates at high speed to deflect the laser beam L for the yellow component in an axial direction of rotation of the photoconductor drum 12 (i.e., the main scanning direction) so that the laser beam L scans the photoconductor drum 12 for yellow. Thus, an electrostatic latent image for yellow is formed on the surface of the photoconductor drum 12 charged by the charging device 14.

Similarly, the laser beam L for the magenta component is emitted to the surface of the photoconductor drum 12 in the second process cartridge 10M from the left in FIG. 1. Consequently, an electrostatic latent image having the magenta component is formed on the surface of the photoconductor drum 12 for magenta. The laser beam L for the cyan component is directed to the photoconductor drum 12 in the third process cartridge 10C from the left in FIG. 1, thus forming an electrostatic latent image having the cyan component on the surface of the photoconductor drum 12 for cyan. The laser beam L for the black component is directed to the photoconductor drum 12 in the fourth process cartridge 10BK from the left in FIG. 1, thus forming an electrostatic latent image having the black component on the surface of the photoconductor drum 12 for black.

Then, the surface of the photoconductor drum 12 having the electrostatic latent image reaches a position opposite a developing device 13. The developing device 13 deposits toner of each color onto the surface of the photoconductor drum 12, thereby developing the electrostatic latent image on the photoconductor drum 12 into a visible toner image (development process).

After the development process, the surfaces of the photoconductor drums 12 reach positions facing the intermediate transfer belt 17. The primary transfer rollers 20 are disposed at the positions where the photoconductor drums 12 face the intermediate transfer belt 17 and in contact with an inner surface of the intermediate transfer belt 17. At the positions of the primary transfer rollers 20, the toner images formed on the photoconductor drums 12 in the respective process cartridges 10Y, 10M, 10C, and 10BK are sequentially transferred to and superimposed on the intermediate transfer belt 17, thereby forming the multicolor toner image thereon (primary transfer process).

After the primary transfer process, the surface of each photoconductor drum 12 reaches a position opposite a cleaning blade (cleaning device) 15. The cleaning blade 15 collects untransferred toner remaining on the photoconductor drum 12 (cleaning process).

Then, the surface of each photoconductor drum 12 passes through a discharge device to complete a sequence of image forming processes performed on each photoconductor drum 12.

As described above, the multicolor toner image is formed on the intermediate transfer belt 17 by transferring and superimposing the respective single-color toner images on the photoconductor drums 12 of the process cartridges 10Y, 10M, 10C, and 10BK. Then, the intermediate transfer belt 17 carrying the multicolor toner image moves clockwise in FIG. 1 to reach a position opposite the secondary transfer roller 18. The secondary transfer roller 18 transfers the multicolor toner image carried on the intermediate transfer belt 17 onto the sheet P (secondary transfer process).

After the secondary transfer process, the surface of the intermediate transfer belt 17 reaches a position opposite the belt cleaning device 19. The belt cleaning device 19 collects untransferred toner adhering to the intermediate transfer belt 17 to complete a sequence of transfer processes performed on the intermediate transfer belt 17.

The sheet P is transported from the sheet feeding device 7 via the registration roller pair 9 to a secondary transfer nip between the intermediate transfer belt 17 and the secondary transfer roller 18.

More specifically, a sheet feeding roller 8 feeds the sheet P from the sheet feeding device 7 that contains a stack of sheets P, and the sheet P is then guided by a sheet guide to the registration roller pair 9. The sheet P that has reached the registration roller pair 9 is transported toward the secondary transfer nip, timed to coincide with the arrival of the multicolor toner image on the intermediate transfer belt 17.

A conveyance belt transports the sheet P bearing the multicolor toner image to the fixing device 30. The fixing device 30 includes a fixing belt and a pressure roller pressing against each other. In a nip therebetween, the multicolor toner image is fixed on the sheet P.

After the fixing process, output rollers eject the sheet P as an output image outside the image forming apparatus 1 to complete a sequence of image forming processes.

Figure 3A:
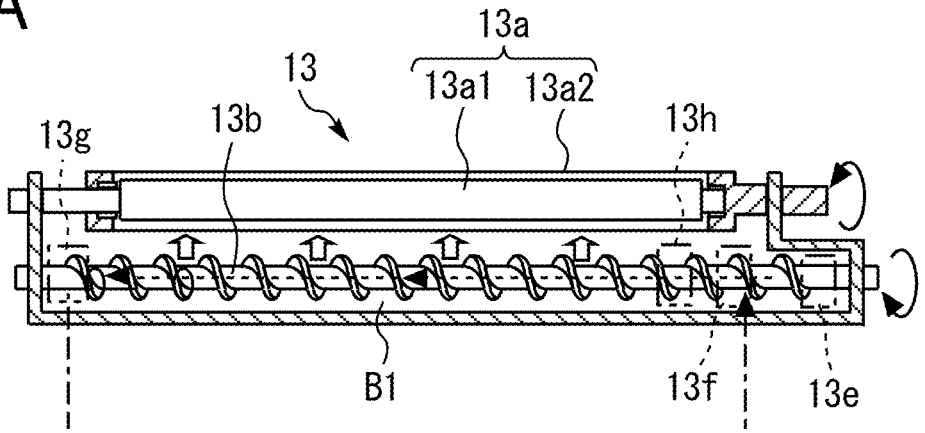
FIG. 3A is a schematic cross-sectional view of an upper portion of a developing device of the image forming unit in FIG. 2 as viewed along a longitudinal axial direction of the developing device.
Figure 3B:
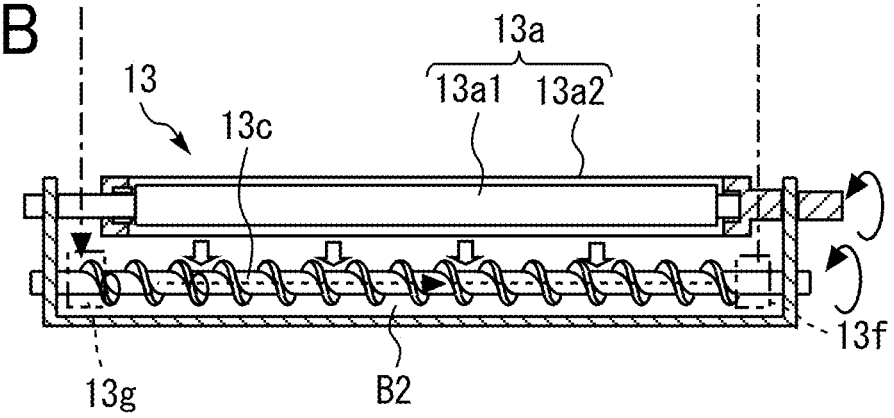
FIG. 3B is a schematic cross-sectional view of a lower portion of the developing device of the image forming unit in FIG. 2 as viewed along the longitudinal axial direction of the developing device.

With reference to FIGS. 2, 3A, and 3B, the process cartridge (image forming unit) 10 is described in further detail below.

Note that, in FIG. 3B, a second conveying screw 13*c* (in particular, the shape of blade) as a developer conveyor is depicted in a simplified manner.

As illustrated in FIG. 2, the process cartridge 10 includes the photoconductor drum 12 as an image bearer, the charging device 14 to charge the photoconductor drum 12, the developing device 13 to develop the electrostatic latent image on the photoconductor drum 12, the cleaning blade (cleaning device) 15 to remove untransferred toner from the photoconductor drum 12, and a lubricant supply device 16 to supply lubricant on the photoconductor drum 12. Each of the replaceable process cartridges 10Y, 10M, 10C, and 10BK is removably installable in the image forming apparatus 1.

It is to be noted that the process cartridges 10Y, 10C, 10M, and 10BK are similar in configuration, and thus the suffixes Y, C, M, and BK are omitted from the process cartridges 10, the photoconductor drums 12, and the developing devices 13 in FIGS. 2, 3A, and 3B and descriptions below for simplicity.

The photoconductor drum 12 as the image bearer used in the present embodiment is an organic photoconductor to be charged to a negative polarity and includes a photosensitive layer formed on a drum-shaped conductive support.

For example, the photoconductor drum 12 is multilayered and includes a base coat serving as an insulation layer, the photosensitive layer, and a protection layer (surface layer), sequentially overlying the conductive support as a substrate. The photosensitive layer includes a charge generation layer and a charge transport layer.

In the present embodiment, the charging device 14 is a roller having an elastic layer of moderate resistivity coating an outer circumference of a conductive core (shaft). The charging device 14 is disposed to contact the photoconductor drum 12 at a position downstream from the lubricant supply device 16 in the direction of rotation of the photoconductor drum 12.

As a predetermined voltage (charging bias) is applied to the charging device 14 by a power source disposed in the image forming apparatus 1, the charging device 14 uniformly charges the surface of the photoconductor drum 12 opposite the charging device 14.

The cleaning blade (cleaning device) 15 is disposed downstream from the lubricant supply device 16 in the direction of rotation of the photoconductor drum 12. For example, in the present embodiment, the cleaning blade 15 is made of rubber, such as urethane rubber, and contacts the surface of the photoconductor drum 12 at a predetermined angle and with a predetermined pressure. With this configuration, substances such as untransferred toner and dust adhering to the surface of the photoconductor drum 12 are mechanically scraped off and are collected in the process cartridge 10. The collected toner is transported toward an excess toner receptacle by a conveying coil 15*b* as excess toner. It is to be noted that the substances adhering to the photoconductor drum 12 include paper dust resulting from the sheet P, discharge products generated on the photoconductor drum 12 during discharge by the charging device 14, additives to the toner, and the like, in addition to the untransferred toner.

The cleaning blade 15 in the present embodiment also serves as a leveling blade to level off, to a suitable layer thickness, the lubricant supplied to the photoconductor drum 12 by a lubricant supply roller 16*a*.

The lubricant supply device 16 includes a solid lubricant 16*b*, the lubricant supply roller 16*a* (e.g., a brush roller) to slidingly contact the photoconductor drum 12 and the solid lubricant 16*b*, a holder 16*e* to hold the solid lubricant 16*b*, and a compression spring 16*c* to bias the holder 16*e*, together with the solid lubricant 16*b*, toward the lubricant supply roller 16*a*.

With this configuration, the lubricant supply device 16 supplies the lubricant to the photoconductor drum 12. The cleaning blade 15 disposed downstream from the lubricant supply device 16 levels off the lubricant on the photoconductor drum 12 to a suitable layer thickness.

With reference to FIG. 2, it can be seen that the developing device 13 includes a developing roller 13*a*, serving as a developer bearer, opposed to the photoconductor drum 12 across a slight gap, thereby forming a development range (a development nip) where a magnetic brush on the developing roller 13*a* contacts the photoconductor drum 12. The developing device 13 contains a two-component developer G including toner T and carrier C. The developing device 13 develops the electrostatic latent image on the photoconductor drum 12 into the toner image. The configuration and operation of the developing device 13 are described in further detail later.

As illustrated in FIG. 1, the toner cartridges (toner containers) 50Y, 50M, 50C, and 50BK contain respective color toners T to be supplied into the developing devices 13. Specifically, depending on the toner concentration (the ratio of toner T in developer G) detected by a magnetic sensor 13*h* (see FIG. 3A) disposed in the developing device 13, a toner supply device supplies the toner T from the corresponding toner cartridge 50 via a toner supply inlet 13*e* (see FIG. 3A) to the developing device 13 as required.

Note that a configuration in which a conveying auger transports toner, a configuration in which a screw pump transports toner together with air, and the like can be used for the toner supply device to supply toner to the developing device 13.

The four toner cartridges 50Y, 50M, 50C, and 50BK are removably installable in the image forming apparatus 1 from the front side of the image forming apparatus 1 in FIG. 1. When the toner in the toner cartridge 50 is depleted, the toner cartridge 50 is replaced.

Next, the developing device 13 of the image forming apparatus 1 is described in further detail below.

With reference to FIGS. 2, 3A, and 3B, the developing device 13 includes the developing roller 13*a* serving as the developer bearer, a first conveying screw 13*b*, the second conveying screw 13*c* serving as the developer conveyor, and a doctor blade 13*d* serving as a developer regulator.

A casing 13*k* of the developing device 13 has an opening therein to partly expose the developing roller 13*a* to the photoconductor drum 12. The developing roller 13*a* includes a cylindrical sleeve 13*a*2 made of a nonmagnetic material and rotates by a drive unit including a drive gear that meshes with a gear disposed on a shaft of the sleeve 13*a*2.

A non-rotatable magnet 13*a*1 is secured inside the sleeve 13*a*2 of the developing roller 13*a*. The magnet 13*a*1 generates multiple magnetic poles around the circumferential surface of the sleeve 13*a*2. The developer G carried on the developing roller 13*a* (the sleeve 13*a*2) is transported to the doctor blade (developer regulator) 13*d* as the developing roller 13*a* rotates in the direction indicated by arrow A1 in FIG. 2. An amount of developer G on the developing roller 13*a* is adjusted to the suitable amount by the doctor blade 13*d*, after which the developer G is transported to the development range opposite the photoconductor drum 12. Then, toner in the developer G is attracted to the electrostatic latent image formed on the photoconductor drum 12 due to the effect of an electric field for development generated in the development range. In FIG. 2, the developing roller 13*a* rotates clockwise, and the photoconductor drum 12 rotates counterclockwise.

The doctor blade 13*d* serving as the developer regulator is opposed to the developing roller 13*a* above the developing roller 13*a*.

The first conveying screw 13*b* and the second conveying screw 13*c* stir and mix the developer G contained in the developing device 13 while transporting the developer G horizontally in a longitudinal axial direction of the first and second conveying screws 13*b* and 13*c* (or the developing roller 13*a*), which is perpendicular to the surface of the paper on which FIG. 2 is drawn and lateral in FIGS. 3A and 3B.

The first conveying screw 13*b* is opposed to the developing roller 13*a* in a supply path B1. The first conveying screw 13*b* supplies a part of the developer G to the developing roller 13*a* as indicated by the blank arrows illustrated in FIG. 3A at the position corresponding to a scooping pole of the magnet 13*a*1 while transporting the developer G to the left in FIG. 3A as indicated by the broken-line arrow illustrated in FIG. 3A.

The second conveying screw 13*c* is disposed below the first conveying screw 13*b* and opposed to the developing roller 13*a* in a collection path B2. After the development process, the developer G separates from the developing roller 13*a* in the direction indicated by the blank arrows in FIG. 3B by a developer release pole, and the second conveying screw 13*c* horizontally transports the developer G that has separated from the developing roller 13*a* to the right in the longitudinal axial direction of the second conveying screw 13*c* as indicated by the broken-line arrow in FIG. 3B.

As indicated by alternate long and short dashed arrows in FIGS. 3A and 3B, the developer G is transported from the downstream side of the supply path B1 (hereinafter, also referred to as "a first transport path") in which the first conveying screw 13*b* is disposed, through a first communication portion 13*g*, and to the collection path B2 (hereinafter, also referred to as "a second transport path") in which the second conveying screw 13*c* is disposed. Then, the second conveying screw 13*c* transports the developer G downstream in the collection path B2 (the second transport path) and to the upstream side of the supply path B1 (the first transport path) through a second communication portion 13*f*.

The first and second conveying screws 13*b* and 13*c* are disposed so that axes of rotation of the first and second conveying screws 13*b* and 13*c* are substantially horizontal, similar to the developing roller 13*a* and the photoconductor drum 12. Each of the first and second conveying screws 13*b* and 13*c* includes a shaft and a helical blade wound around the shaft. That is, as described in detail later with reference to FIG. 4, the second conveying screw 13*c* includes a shaft 13*c*4, a first blade 13*c*1 and a third blade 13*c*3 wound around the shaft 13*c*4.

An inner wall (a partition) of the developing device 13 separates the supply path B1 (the first transport path) in which the first conveying screw 13*b* is disposed and the collection path B2 (the second transport path) in which the second conveying screw 13*c* is disposed.

With reference to FIGS. 3A and 3B, the downstream side of the collection path B2, in which the second conveying screw 13*c* is disposed, communicates with the upstream side of the supply path B1, in which the first conveying screw 13*b* is disposed, via the second communication portion 13*f*. The developer G that has reached the downstream side of the collection path B2 accumulates adjacent to the second communication portion 13*f* and then is transported or supplied to the upstream side of the supply path B1 via the second communication portion 13*f*.

The downstream side of the supply path B1, in which the first conveying screw 13*b* is disposed, communicates with the upstream side of the collection path B2, in which the second conveying screw 13*c* is disposed, via the first communication portion 13*g*. The developer G that is not supplied to the developing roller 13*a* in the supply path B1 falls through the first communication portion 13*g* to the upstream side of the collection path B2.

Figure 4:
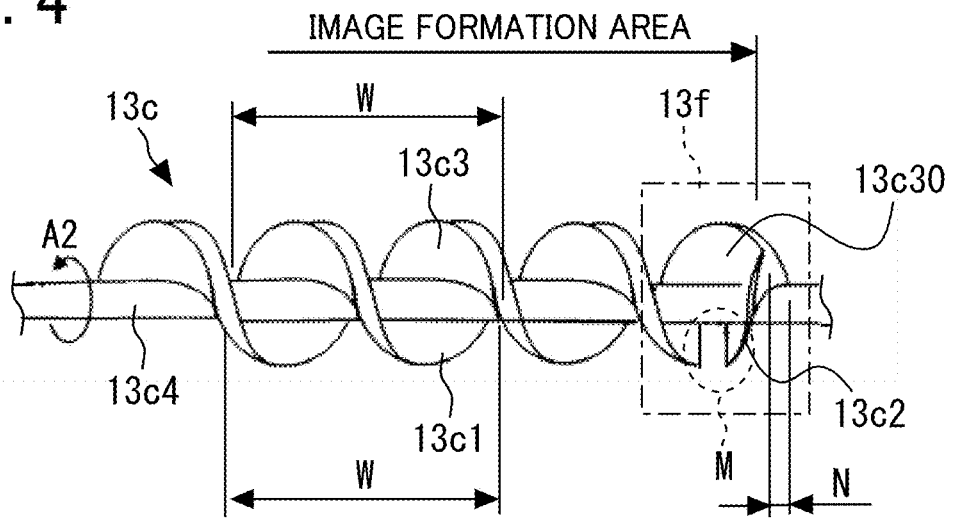
FIG. 4 is a schematic view illustrating a part of a second conveying screw of the developing device along the longitudinal axial direction according to an embodiment of the present disclosure.

Further, the second conveying screw 13*c* includes a second blade 13*c*2 (see FIG. 4) to facilitate conveyance of the developer G at a position corresponding to the second communication portion 13*f*, which is conveyance from the collection path B2 to the supply path B1 against gravity. The second blade 13*c*2, which is described in detail later with reference to FIG. 4, is disposed on the downstream side of the second conveying screw 13*c* and wound around the shaft 13*c*4 in a direction opposite the helical blade (i.e., the first blade 13*c*1 and the third blade 13*c*3).

Such a configuration provides a circulation path through which the developer G is circulated in the longitudinal axial direction by the first and second conveying screws 13*b* and 13*c* in the developing device 13. That is, when the developing device 13 operates, the developer G contained therein flows in the direction indicated by the broken-line arrows illustrated in FIGS. 3A and 3B. Separating the supply path B1 from the collection path B2 can reduce density unevenness of toner images formed on the photoconductor drum 12. In the supply path B1 (the first transport path), the first conveying screw 13*b* supplies the developer G to the developing roller 13*a*. In the collection path B2 (the second transport path), the developer G is collected from the developing roller 13*a* by the second conveying screw 13*c*.

With reference to FIG. 3A, it can be seen that, in the supply path B1, the magnetic sensor 13*h* to detect the toner concentration in the developer G circulated in the developing device 13 is disposed below the first conveying screw 13*b*, on the upstream side of the supply path B1. Based on the toner concentration detected by the magnetic sensor 13*h*, fresh toner T is supplied from the toner cartridge 50 to the developing device 13 through the toner supply inlet 13*e* disposed adjacent to the second communication portion 13*f*.

Additionally, with reference to FIG. 3A, the toner supply inlet 13*e* is disposed above the upstream side of the supply path B1 (the first transport path), in which the first conveying screw 13*b* is disposed, away from the development range. In other words, the toner supply inlet 13*e* is disposed outside a region occupied by the developing roller 13*a* in the longitudinal direction of the developing roller 13*a*.

It is to be noted that, in the present embodiment, the position of the toner supply inlet 13*e* is, but is not limited to, inside the supply path B1 (the first transport path). Alternatively, the toner supply inlet 13*e* can be disposed above the upstream side of the collection path B2, for example.

With reference to FIG. 4, the configuration and operation of the second conveying screw 13*c* of the developing device 13 (the process cartridge 10) according to the present embodiment are described in further detail below.

As described above with reference to FIGS. 2, 3A, and 3B, the developing device 13 includes the second conveying screw 13*c* as the developer conveyor.

In the developing device 13, the supply path B1 and the collection path B2 constitute the circulation path to circulate the developer G. The first conveying screw 13*b* supplies the developer G to the developing roller (developer bearer) 13*a* while transporting the developer G from one end to the other end in the longitudinal axial direction in the supply path B1. On the other hand, the second conveying screw (developer conveyor) 13*c* transports the developer G separating from the developing roller 13*a*, from the other end (left side in FIG. 4) to the one end (right side in FIG. 4) in the longitudinal axial direction in the collection path B2. The supply path B1 and the collection path B2 together define the circulation path to circulate the developer G.

As illustrated in FIG. 4, the second conveying screw 13*c* as the developer conveyor includes the shaft 13*c*4, the first blade 13*c*1, the second blade 13*c*2, and the third blade 13*c*3 including an extended blade portion 13*c*30.

The first blade 13*c*1 is helically wound in a first direction on the shaft 13*c*4. As illustrated in FIG. 4, the first blade 13*c*1 is right-handed in the present embodiment. On the other hand, the second blade 13*c*2 is disposed away from an end of the first blade 13*c*1 with a gap M in the longitudinal axial direction and helically wound in a second direction opposite the first direction on the shaft 13*c*4. As illustrated in FIG. 4, the second blade 13*c*2 is left-handed in the present embodiment. That is, the first blade 13*c*1 that is right-handed and the second blade 13*c*2 that is left-handed are arranged in a row with the gap M in the longitudinal axial direction on the shaft 13*c*4.

The second conveying screw 13*c* rotates to allow the first blade 13*c*1 and the third blade 13*c*3 to transport the developer G from the other end (left side in FIG. 4) to the one end (right side in FIG. 4) in the longitudinal axial direction in the collection path B2. The third blade 13*c*3 is described in detail later. That is, as a driver drives the developing device 13, the second conveying screw 13*c* is driven to rotate in the direction indicated by arrow A2 in FIG. 4, thereby transporting the developer G from the left to the right in FIG. 4 in the collection path B2.

The gap M between the first blade 13*c*1 and the second blade 13*c*2 is disposed at the one end in the longitudinal axial direction and near the second communication portion 13*f* through which the developer G is transported from the collection path B2 to the supply path B1.

Thus, with the gap M (space) between the first blade 13*c*1 that is right-handed and the second blade 13*c*2 that is left-handed, the developer G can be retained at the position corresponding to the gap M in the longitudinal axial direction. That is, at the position of the gap M, the developer G transported rightward in FIG. 4 by the first blade 13*c*1 (and the third blade 13*c*3 to be described later) collides with the developer G transported leftward in FIG. 4 by the second blade 13*c*2 and piles at the gap M. The second communication portion 13*f* disposed near the gap M facilitates transport of the developer G against gravity from the collection path B2 to the supply path B1 through the second communication portion 13*f*. As a result, the developer G flows smoothly through the second communication portion 13*f*.

In addition, as noted above, the second conveying screw 13*c* according to the present embodiment includes the third blade 13*c*3 including the extended blade portion 13*c*30. The extended blade portion 13*c*30 is helically wound in the first direction on the shaft 13*c*4 at least at the position where the gap M is formed. As illustrated in FIG. 4, the extended blade portion 13*c*30 is right-handed in the present embodiment.

Specifically, in the present embodiment, the first blade 13*c*1 and the third blade 13*c*3 are wound in double-start thread from one end of the first blade 13*c*1 to the opposite end of the first blade 13*c*1 in the longitudinal axial direction. That is, in the second conveying screw 13*c*, the first blade 13*c*1 and third blade 13*c*3 in double-start thread are disposed in a range from the left end portion in FIG. 4, which is near the first communication portion 13*g* illustrated in FIG. 3B, to the upstream side of the gap M located on the right end portion in FIG. 4. In addition, the third blade 13*c*3 is wound beyond the position of the gap M to further downstream (to the right in FIG. 4). In other words, the third blade 13*c*3 is longer than the first blade 13*c*1 by a length of the extended blade portion 13*c*30. The extended blade portion 13*c*30 is wound in the first direction and in single-start thread.

The reason why the third blade 13*c*3 is provided at the position on the shaft 13*c*4 where the gap M is formed is to prevent the developer G from jumping up vigorously at the position of the gap M.

Figure 5:
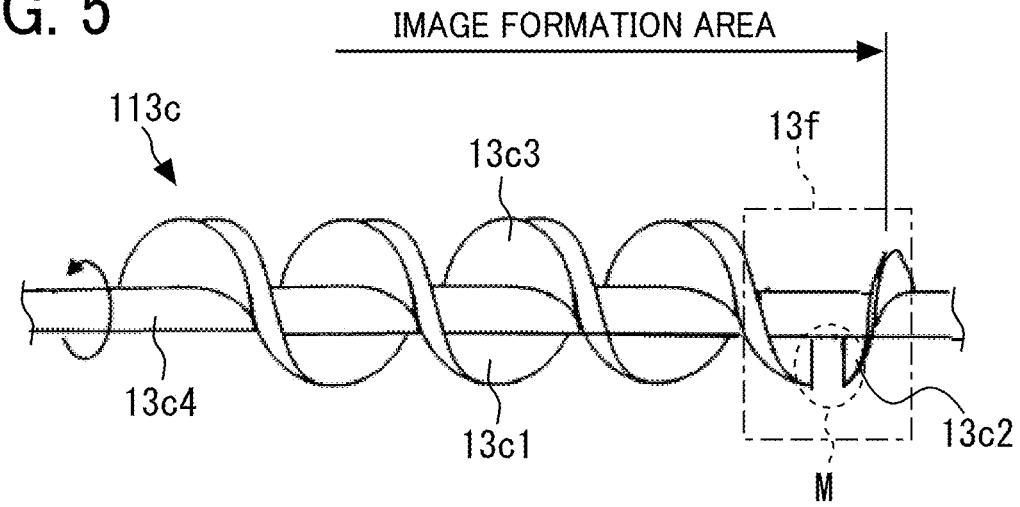
FIG. 5 is a schematic view illustrating a part of a second conveying screw along the longitudinal axial direction according to a comparative example.

That is, like a comparative conveying screw 113*c* illustrated in FIG. 5, when an extended blade portion is not formed at the position of the gap M between the first blade 13*c*1 that is right-handed and the second blade 13*c*2 that is left-handed, although the developer G can be retained at the position of the gap M, the developer G that has collided at the position of the gap M is likely to jump upward. If the developer G jumps up into the supply path B1 via the second communication portion 13*f* and is directly carried on the developing roller 13*a*, an abnormal image such as an image density unevenness at the pitch of the conveyance screw 113*c* is likely to occur. In particular, as illustrated in FIGS. 4 and 5, when the second communication portion 13*f* is disposed within or near an image formation area, an abnormal image is more likely to occur due to the developer G that jumps upward and is carried on the developing roller 13*a*. The image formation area is a range of images formed on the photoconductor drum 12 in the longitudinal axial direction.

In the present embodiment, the third blade 13*c*3 includes the extended blade portion 13*c*30 disposed at the position of the gap M between the first blade 13*c*1 that is right-handed and the second blade 13*c*2 that is left-handed. The extended blade portion 13*c*30 has the ability to transport the developer G to the right in FIG. 4. Therefore, the developer G can be appropriately retained at the position of the gap M while the degree of collision of the developer G is reduced. As a result, the developer G can be smoothly transported through the second communication portion 13*f* and the abnormal image due to the jump of the developer G can be prevented.

As illustrated in FIG. 4, a part of the second blade 13*c*2 is coupled to the extended blade portion 13*c*30 of the third blade 13*c*3.

More specifically, the inner periphery of the second blade 13*c*2 is coupled to the shaft 13*c*4, and the end of the second blade 13*c*2 on the side opposite the portion facing the gap M is coupled to the extended blade portion 13*c*30.

This configuration enhances the mechanical strength of the second blade 13*c*2 as compared with the case in which the end of the second blade 13*c*2 is not coupled to any other component.

In addition, as illustrated in FIG. 4, the end of the second blade 13*c*2 on the side opposite the portion facing the gap M is closer to the gap M than the end of the extended blade portion 13*c*30. That is, the downstream end of the second blade 13*c*2 is located upstream (i.e., to the left in FIG. 4) from the downstream end of the extended blade portion 13*c*30 by a distance N.

With this configuration, the downstream end of the second blade 13*c*2 can be firmly coupled to the extended blade portion 13*c*30, and the mechanical strength of the second blade 13*c*2 can be enhanced.

As illustrated in FIG. 4, in the second conveying screw 13*c* according to the present embodiment, the second blade 13*c*2 has a lead shorter than a lead W of the first blade 13*c*1. Here, the lead is the axial distance that the developer G is transported when the screw rotates in one revolution. The pitch is the axial distance between adjacent threads of the screw. In the double-start thread, the lead is twice the pitch.

Accordingly, in the gap M, the ability to transport the developer G to the left in FIG. 4 is weaker than the ability to transport the developer G to the right in FIG. 4. As a result, the developer G is not retained enough to jump up vigorously.

As illustrated in FIG. 4, in the second conveying screw 13*c* according to the present embodiment, the third blade 13*c*3 has a lead W equivalent to the lead W of the first blade 13*c*1.

Specifically, in the second conveying screw 13*c* according to the present embodiment, the first blade 13*c*1 and the third blade 13*c*3 have the lead W of about 30 mm and the pitch of about 15 mm, and the second blade 13*c*2 has the lead of about 15 mm.

The diameter of the shaft 13*c*4 is about 6 mm, and the heights of the first, second, and third blades 13*c*1, 13*c*2, and 13*c*3 are about 4.5 mm. That is, the outer diameter of the second conveying screw 13*c* is about 15 mm.

As described above, the second conveying screw 13*c* as a developer conveyor includes the shaft 13*c*4, the first blade 13*c*1 helically wound around the shaft 13*c*4 in the first direction, the second blade 13*c*2 disposed away from the end of the first blade 13*c*1 with the gap M in the longitudinal axial direction of the developer conveyor and helically wound around the shaft 13*c*4 in the second direction opposite the first direction, and the extended blade portion 13*c*30 of the third blade 13*c*3 helically wound around the shaft 13*c*4 in the first direction at least at the position where the gap M is formed.

This configuration can prevent the developer G from jumping up at the position of the gap M between the first blade 13*c*1 wound in the first direction and the second blade 13*c*2 wound in the second direction.

As a result, according to the present disclosure, a developer conveyor, a developing device, a process cartridge, and an image forming apparatus can be provided that prevent a developer from jumping up at the position of the gap between the first blade wound in the first direction and the second blade wound in the second direction.

In the above-described embodiments, the present disclosure is applied to the developing device 13 that is a component of the process cartridge 10 and coupled with other image forming components. Alternatively, the present disclosure is not limited to the above described configuration and can be readily applied to an image forming apparatus in which a developing device is removably installable as a single unit and does not constitute a process cartridge together with other components.

It is to be noted that the term "process cartridge" used in the present disclosure means a removable unit including an image bearer and at least one of a charging device to charge the image bearer, a developing device to develop latent images on the image bearer, and a cleaning device to clean the image bearer that are united together, and is designed to be removably installed as a united part in the image forming apparatus.

Further, in the above-described embodiments, the present disclosure is applied to the developing device 13 including one developing roller 13*a* and the first and second conveying screws 13*b* and 13*c* arranged in the vertical direction. However, the various aspects of the present disclosure are not limited to the above-described developing device 13 but are also applicable to other types of developing devices. For example, the present disclosure can be readily applied to a developing device including multiple developing rollers disposed opposite the image bearer in a vertical arrangement, a developing device including two conveying screws arranged horizontally, a developing device including three or more conveying screws, and the like. In these cases, the developer conveyor according to the present disclosure is used for at least one of the conveying screws provided in the developing device.

In such configurations, effects similar to those of the above-described embodiments are also attained.

Although the descriptions above concern a developing device that circulates a two-component developer including toner and carrier, alternatively, the present disclosure can also be applied to a developing device that circulates a one-component developer including only toner.

In such configurations, effects similar to those described above are also attained.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. The number, position, and shape of the components described above are not limited to those embodiments described above. Desirable number, position, and shape can be determined to perform the present disclosure.

What is claimed is:

1. A developer conveyor, comprising:

a shaft;

a first blade helically wound around the shaft in a first direction;

a second blade disposed away from an end of the first blade with a gap therebetween in a longitudinal axial direction of the developer conveyor, and helically wound around the shaft in a second direction opposite the first direction; and a third blade helically wound around the shaft in the first direction at least at a position where the gap is formed, wherein the third blade is disposed over an entirety of the gap in the longitudinal direction.

2. The developer conveyor according to claim 1, wherein the second blade has a lead shorter than a lead of the first blade.

3. The developer conveyor according to claim 1, wherein the third blade has a lead equivalent to a lead of the first blade.

4. A developing device comprising the developer conveyor according to claim 1.

5. The developing device according to claim 4, further comprising:

a developer bearer opposed to an image bearer;

a supply path configured to supply a developer to the developer bearer while transporting the developer from one end to other end in the longitudinal axial direction of the developer conveyor;

a collection path in which the developer conveyor is configured to transport the developer separating from the developer bearer from the other end to the one end in the longitudinal axial direction of the developer conveyor; and a communication portion through which the developer is transported from the collection path to the supply path, wherein the supply path and the collection path together define a circulation path to circulate the developer, wherein the developer conveyor is configured to rotate to allow the first blade and the third blade to transport the developer from the other end to the one end in the longitudinal axial direction of the developer conveyor, and wherein the gap is disposed near the communication portion.

6. The developing device according to claim 5, wherein the communication portion is disposed within or near an image formation area of the developing device.

7. A process cartridge comprising the developing device according to claim 4, wherein the process cartridge is removably installable in an image forming apparatus.

8. An image forming apparatus comprising the developing device according to claim 4.

9. A developer conveyor, comprising:

a shaft;

a first blade helically wound around the shaft in a first direction:

a second blade disposed away from an end of the first blade with a gap in a longitudinal axial direction of the developer conveyor and helically wound around the shaft in a second direction opposite the first direction; and a third blade helically wound around the shaft in the first direction at least at a position where the gap is formed, wherein the first blade and the third blade are wound in a double-start thread from end to end of the first blade in the longitudinal axial direction.

10. A developer conveyor, comprising:

a shaft:

a first blade helically wound around the shaft in a first direction;

a second blade disposed away from an end of the first blade with a gap in a longitudinal axial direction of the developer conveyor and helically wound around the shaft in a second direction opposite the first direction; and a third blade helically wound around the shaft in the first direction at least at a position where the gap is formed, wherein a part of the second blade is coupled to the third blade.

11. A developer conveyor, comprising:

a shaft:

a first blade helically wound around the shaft in a first direction;

a second blade disposed away from an end of the first blade with a gap in a longitudinal axial direction of the developer conveyor and helically wound around the shaft in a second direction opposite the first direction; and a third blade helically wound around the shaft in the first direction at least at a position where the gap is formed, wherein an end of the second blade on a side opposite a portion of the second blade facing the gap is closer to the gap than an end of the third blade on a side farther from the first blade in the longitudinal axial direction.

* * * * *